US009010250B1

(12) United States Patent
Evangelisti et al.

(10) Patent No.: US 9,010,250 B1
(45) Date of Patent: Apr. 21, 2015

(54) FUZE PULL PIN DETENT DEVICE

(71) Applicants: Matthew P. Evangelisti, Denville, NJ (US); Steve Kotefski, Bloomingdale, NJ (US); Lidija Kotevska, Blooingdale, NJ (US)

(72) Inventors: Matthew P. Evangelisti, Denville, NJ (US); Steve Kotefski, Bloomingdale, NJ (US); Lidija Kotevska, Blooingdale, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/037,920

(22) Filed: Sep. 26, 2013

(51) Int. Cl.
*F42B 27/08* (2006.01)

(52) U.S. Cl.
CPC ..... *F42B 27/08* (2013.01)

(58) Field of Classification Search
CPC ..... F42C 14/02; F42C 19/02; F42C 19/00; F42B 27/00; F42B 8/26
USPC ..... 102/482, 486, 202.1, 202.3, 221, 222, 102/236, 258, 260, 487
See application file for complete search history.

(56) References Cited

U.S. PATENT DOCUMENTS

| | | | | |
|---|---|---|---|---|
| 6,349,650 | B1 * | 2/2002 | Brunn et al. | 102/368 |
| 2013/0239838 | A1 * | 9/2013 | Kravel | 102/487 |

* cited by examiner

*Primary Examiner* — Samir Abdosh
*Assistant Examiner* — John D Cooper
(74) *Attorney, Agent, or Firm* — Michael C. Sachs

(57) ABSTRACT

A grenade fuze assembly includes a fuze body and a striker lever fixed to the fuze body with a pull pin. A circular pull ring is attached to the pull pin. A detent device is disposed on a top portion of the fuze body and a top portion of the striker lever. The detent device includes four sides with a boss formed on an exterior of one of the four sides. The boss includes a curved slot for receiving and holding the pull ring. A pair of opposed locking tabs on opposite interior sides of the detent device engage the top portion of the fuze body. The detent device secures the pull ring to prevent accidental removal of the pull pin when the grenade is dropped and to prevent undesired noise cause by movement of the pull pin and pull ring.

3 Claims, 2 Drawing Sheets

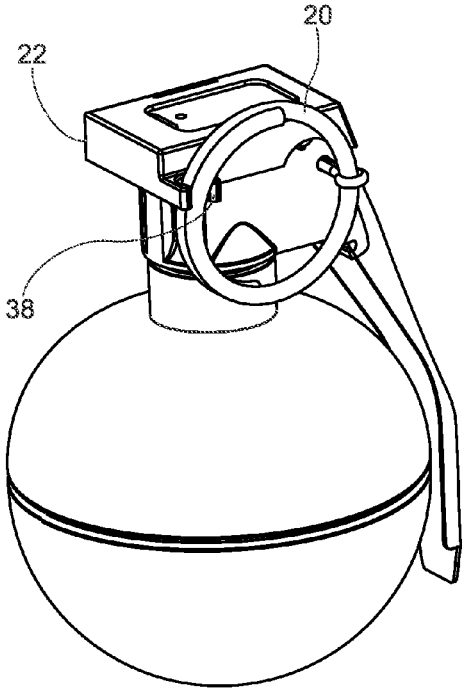
Fig. 3
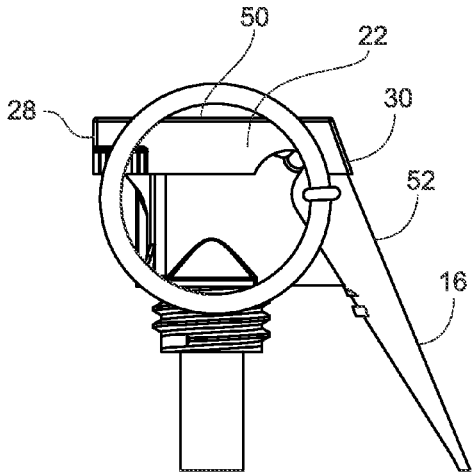
Fig. 4
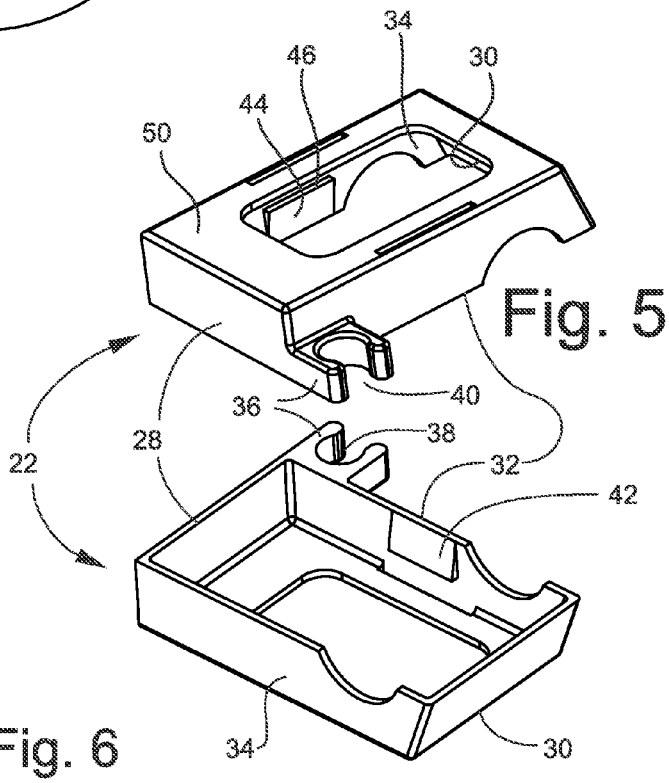
Fig. 5
Fig. 6

FUZE PULL PIN DETENT DEVICE

STATEMENT OF GOVERNMENT INTEREST

The inventions described herein may be manufactured, used and licensed by or for the United States Government.

BACKGROUND OF THE INVENTION

The invention relates in general to grenades, and in particular to hand grenades.

When it explodes, the time-delay, fragmentation, anti-personnel hand grenade launches hundreds of small metal fragments in every direction. These sorts of grenades are designed to be durable, easy to use and easy to manufacture. The grenade firing mechanism is triggered by a spring-loaded striker inside the grenade. Normally, the striker is held in place by the striker lever on top of the grenade, which is held in place by the pull pin. The pull pin has a pull ring attached at one end. In use, a soldier grips the grenade so the striker lever is pushed up against the grenade body, grips the pull ring and removes the pull pin, and then tosses the grenade.

Retaining the pull pin in place is a concern with grenade fuzes. If the pull pin is inadvertently removed, the grenade becomes armed. In the past, soldiers would tape the pull ring to the grenade fuze in an attempt to enhance safety and to reduce noise caused by movement of the pull ring and pull pin. Removing the tape, however, sometimes inadvertently and undesirably removed the pull pin. To overcome this problem, some grenades now include a "confidence clip" to support the pull ring. However, the confidence clip is not a completely satisfactory solution. And, the pull pin may still generate undesired noise when the grenade is moved, even with the confidence clip.

A need exists for an apparatus that can be installed on existing grenades to prevent accidental removal of the pull pin when the grenade is dropped and to prevent undesired noise cause by movement of the pull pin and pull ring.

SUMMARY OF INVENTION

One aspect of the invention is a detent device for securely holding the pull ring of a grenade. The detent device includes a generally rectangular hollow body having four sides. A boss is formed on the exterior of one of the four sides. The boss includes a curved slot for receiving and holding the pull ring with a snap fit. The curved slot includes a narrowed opening. A pair of opposed locking tabs are formed on respective opposite interiors of two of the four sides of the detent device. The pair of opposed locking tabs provide a snap fit with the fuze body to thereby constrain translation of the detent device with respect to the fuze body along the longitudinal axis of the grenade fuze body. One of the four sides is an angled side that is angled with respect to a top surface of the detent device. One of the four sides opposite the angled side is normal to the top surface of the detent device.

Another aspect of the invention is a grenade fuze assembly including a fuze body with a longitudinal axis. A striker lever is fixed to the fuze body with a pull pin. A circular pull ring is attached to the pull pin. The pull ring is made of a wire with a circular cross-section. A detent device is disposed on a top portion of the fuze body and a top portion of the striker lever. The detent device includes four sides. A boss is formed on an exterior of one of the four sides. The boss includes a curved slot for receiving and holding the pull ring. A pair of opposed locking tabs are formed on respective opposite interiors of two of the four sides of the detent device. The pair of opposed locking tabs engage the top portion of the fuze body.

The pull ring may include an overlapping portion having two coils of the wire. The curved slot may include a narrowed opening. The pull ring and the curved slot may form a snap fit. The opposed locking tabs may create a snap fit with the top portion of the fuze body.

Each locking tab may include a shoulder that engages an edge of the strike lever. The opposed locking tabs may constrain translation of the detent device with respect to the fuze body along the longitudinal axis.

One of the four sides of the detent device may be an angled side that is angled with respect to a top surface of the detent device, to conform to a surface of the striker lever. One of the four sides opposite the angled side may be normal to the top surface of the detent device.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 3 is a perspective view of the grenade of FIG. 1 with a detent device installed.

FIG. 4 is a side view of the fuze assembly of the grenade in FIG. 4.

FIG. 5 is a top perspective view of one embodiment of a detent device.

FIG. 6 is a bottom perspective view of the device of FIG. 5.

DETAILED DESCRIPTION

Figure 1:
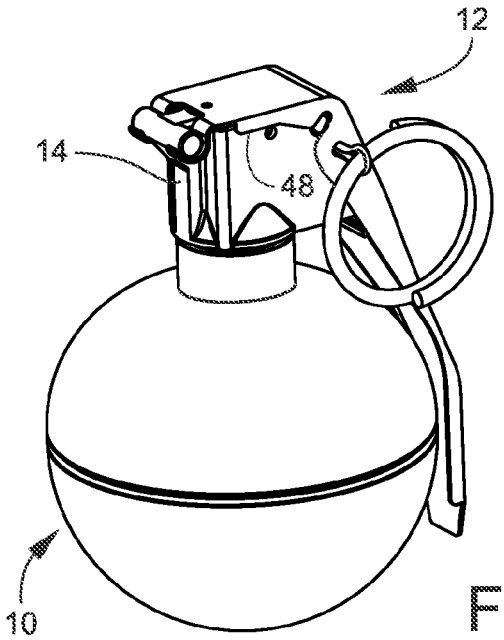
Fig. 1 Prior Art
FIG. 1 is a perspective view of a known grenade.
Figure 2:
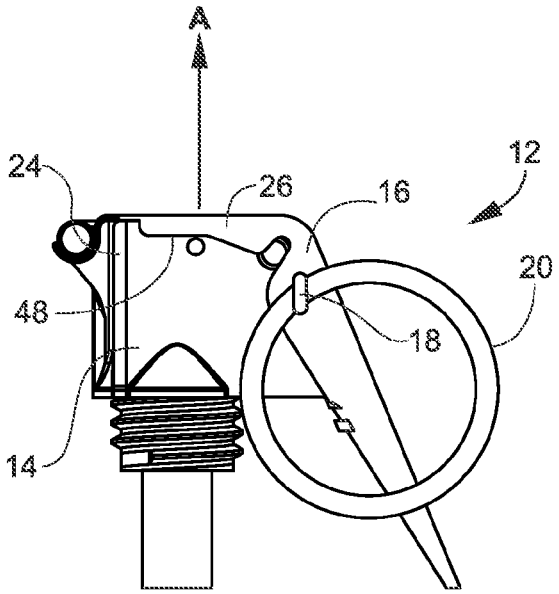
Fig. 2 Prior Art
FIG. 2 is a side view of the fuze assembly of the grenade in FIG. 1.

FIG. 1 is a perspective view of a known grenade 10 having a fuze assembly 12. FIG. 2 is a side view of fuze assembly 12. Fuze assembly 12 includes a fuze body 14 having a longitudinal axis A and a striker lever 16 fixed to fuze body 14 with a pull pin 18. A circular pull ring 20 is attached to pull pin 18. Pull ring 20 is made of a wire with a circular cross-section.

FIG. 3 is a perspective view of grenade 10 of FIG. 1 with a novel detent device 22 installed thereon. FIG. 4 is a side view of fuze assembly 12 with detent device 22 installed thereon. FIG. 5 is a top perspective view and FIG. 6 is a bottom perspective view of one embodiment of detent device 22. Detent device 22 is disposed on a top portion 24 (FIG. 2) of fuze body 14 and a top portion 26 of striker lever 16.

As seen in FIGS. 5 and 6, detent device 22 is a generally rectangular hollow body having four sides 28, 30, 32, 34. Sides 28 and 30 are opposing sides and sides 32 and 34 are opposing sides. The exterior of side 32 includes a boss 36 formed thereon. Boss 36 includes a curved slot 38 for receiving and holding pull ring 20 (FIG. 2). Curved slot 38 has a narrowed opening 40 such that a small amount of force is needed to insert pull ring 20 (FIG. 2) in slot 38 and remove pull ring 20 from slot 38. Thus, as seen in FIG. 3, pull ring 20 is held in slot 38 with a press, friction, or snap fit.

A pair of opposed locking tabs 42, 44 (FIGS. 5 and 6) are formed on respective interiors of opposing sides 32, 34 of detent device 22. Tabs 42, 44 have a varying thickness that increases in the direction away from fuze body 24. In FIG. 5, the thickness of tab 44 increases in an upward direction. In FIG. 6, because detent device 22 is shown upside down, the thickness of tab 42 increases in a downward direction. Tabs 42, 44 may have a ramp profile. When detent device 22 is pushed onto top portion 24 of fuze body 14 and top portion 26 of strike lever 16, a shoulder 46 (FIG. 5) at the top of each tab 42, 44 engages a bottom edge 48 (FIGS. 1 and 2) of strike lever 26, providing a press, friction, or snap fit. Only one shoulder 46 can be seen in FIG. 5. Shoulders 46 restrain translation of detent device 22 with respect to fuze body 24 along longitudinal axis A.

As best seen in FIG. 4, side 30 of detent device 22 is angled to conform to the angle of surface 52 of strike lever 16. Side 28 that is opposite side 30 may be normal to top surface 50 (FIGS. 4 and 5) of detent device 22.

While the invention has been described with reference to certain embodiments, numerous changes, alterations and modifications to the described embodiments are possible without departing from the spirit and scope of the invention as defined in the appended claims, and equivalents thereof.

What is claimed is:

1. A grenade fuze assembly, comprising:

a fuze body having a longitudinal axis;

a striker lever fixed to the fuze body with a pull pin;

a circular pull ring attached to the pull pin, the pull ring being made of a wire with a circular cross-section;

a detent device disposed on a top portion of the fuze body and a top portion of the striker lever, the detent device including four sides;

a boss formed on an exterior of one of the four sides, the boss including a curved slot for receiving and holding the pull ring; and a pair of opposed locking tabs formed on respective opposite interiors of two of the four sides of the detent device wherein the pair of opposed locking tabs engage the top portion of the fuze body, wherein the curved slot includes a narrowed opening, wherein the opposed locking tabs create a snap fit with the top portion of the fuze body, wherein one of the four sides of the detent device is an angled side that is angled with respect to a top surface of the detent device, to conform to a surface of the strike lever, and wherein one of the four sides opposite the angled side is normal to the top surface of the detent device.

2. A detent device for holding a pull ring of a grenade having a fuze body with a longitudinal axis, comprising:

a generally rectangular hollow body having four sides;

a boss formed on an exterior of one of the four sides, the boss including a curved slot for receiving and holding the pull ring with a snap fit, the curved slot including a narrowed opening; and a pair of opposed locking tabs formed on respective opposite interiors of two of the four sides of the detent device, the pair of opposed locking tabs providing a snap fit with the fuze body to thereby constrain translation of the detent device with respect to the fuze body along the longitudinal axis;

wherein one of the four sides is an angled side that is angled with respect to a top surface of the detent device and one of the four sides opposite the angled side is normal to the top surface of the detent device.

3. A grenade fuze assembly, comprising:

a fuze body having a longitudinal axis;

a striker lever fixed to the fuze body with a pull pin;

a circular pull ring attached to the pull pin, the pull ring being made of a wire with a circular cross-section;

a detent device disposed on a top portion of the fuze body and a top portion of the striker lever, the detent device including a generally rectangular hollow body having four sides;

a boss formed on an exterior of one of the four sides, the boss including a curved slot for receiving and holding the pull ring with a snap fit, the curved slot including a narrowed opening; and a pair of opposed locking tabs formed on respective opposite interiors of two of the four sides of the detent device, the pair of opposed locking tabs providing a snap fit with the fuze body to thereby constrain translation of the detent device with respect to the fuze body along the longitudinal axis, and wherein one of the four sides is an angled side that is angled with respect to a top surface of the detent device and one of the four sides opposite the angled side is normal to the top surface of the detent device.

* * * * *